US007185832B2

(12) United States Patent
Kaden et al.

(10) Patent No.: US 7,185,832 B2
(45) Date of Patent: Mar. 6, 2007

(54) FUEL INJECTION NOZZLE FOR AN INTERNAL COMBUSTION ENGINE WITH DIRECT FUEL INJECTION

(75) Inventors: Arnold Kaden, Remshalden (DE); Christian Krüger, Stuttgart (DE); Oliver Steil, Maikammer (DE)

(73) Assignee: DaimlerChrysler AG, Stuttgart (DE)

( * ) Notice: Subject to any disclaimer, the term of this patent is extended or adjusted under 35 U.S.C. 154(b) by 117 days.

(21) Appl. No.: 11/032,316

(22) Filed: Jan. 10, 2005

(65) Prior Publication Data

US 2005/0150978 A1 Jul. 14, 2005

Related U.S. Application Data

(63) Continuation-in-part of application No. PCT/EP03/06985, filed on Jul. 1, 2003.

(30) Foreign Application Priority Data

Jul. 11, 2002 (DE) ..... 102 31 583.3

(51) Int. Cl.
*F02M 61/08* (2006.01)

(52) U.S. Cl. ..... 239/533.7; 239/453; 239/461; 239/499; 239/500; 239/502; 239/506; 239/533.12; 239/584

(58) Field of Classification Search ..... 239/452, 239/453, 500, 502, 506, 515, 533.7, 533.12, 239/584, 461, 499
See application file for complete search history.

(56) References Cited

U.S. PATENT DOCUMENTS

| | | | | |
|---|---|---|---|---|
| 2,263,197 | A * | 11/1941 | Tabb et al. | 239/453 |
| 2,719,055 | A * | 9/1955 | Lauck | 239/460 |
| 2,753,217 | A * | 7/1956 | Pccora, Jr. et al. | 239/453 |
| 4,408,722 | A * | 10/1983 | Frelund | 239/453 |
| 6,105,879 | A * | 8/2000 | Potz et al. | 239/533.7 |
| 6,340,017 | B1 * | 1/2002 | Dick | 239/533.7 |

FOREIGN PATENT DOCUMENTS

| | | |
|---|---|---|
| DE | 42 28 359 | 12/1993 |
| DE | 196 42 653 | 1/1998 |
| DE | 100 12 970 | 9/2001 |
| WO | WO 93/04277 | 3/1993 |
| WO | WO 02/02932 | 1/2002 |

* cited by examiner

*Primary Examiner*—Steven J. Ganey
(74) *Attorney, Agent, or Firm*—Klaus J. Bach

(57) ABSTRACT

In an injection nozzle for an internal combustion engine including a nozzle housing, a closure member disposed in a nozzle opening and connected to a nozzle needle for axially moving the closure member outwardly off its seat in the nozzle opening to open the nozzle by providing a gap to permit fuel to be discharged into a combustion chamber of an internal combustion engine so as to form a fuel injection cone, the nozzle seal and the closure member have seal surface areas provided with turbulence chambers for imparting turbulence to the fuel flowing through the gap in order to more finely atomize the fuel forming the fuel cone in the combustion chamber.

9 Claims, 4 Drawing Sheets

FIG. 3
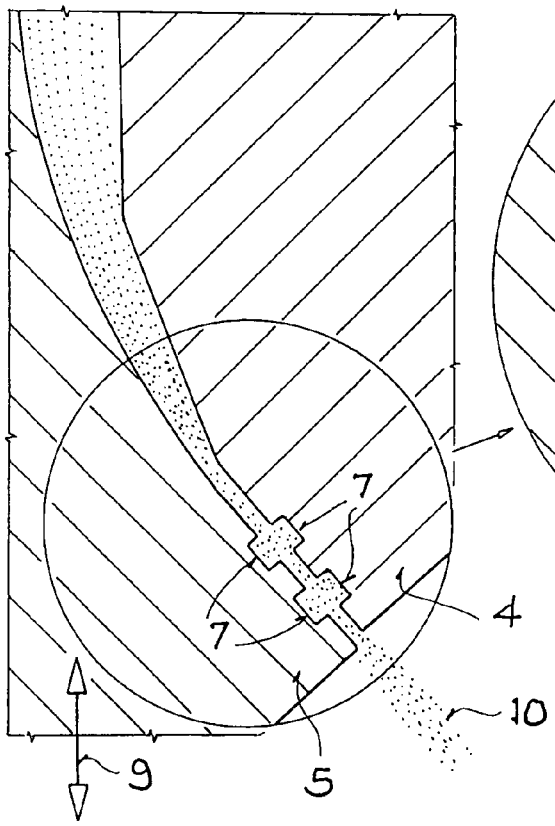
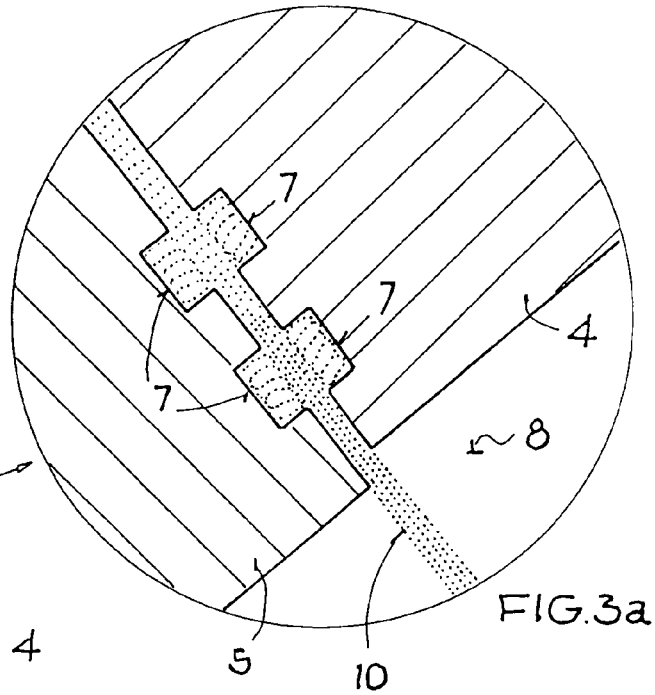
FIG.3a
FIG. 4
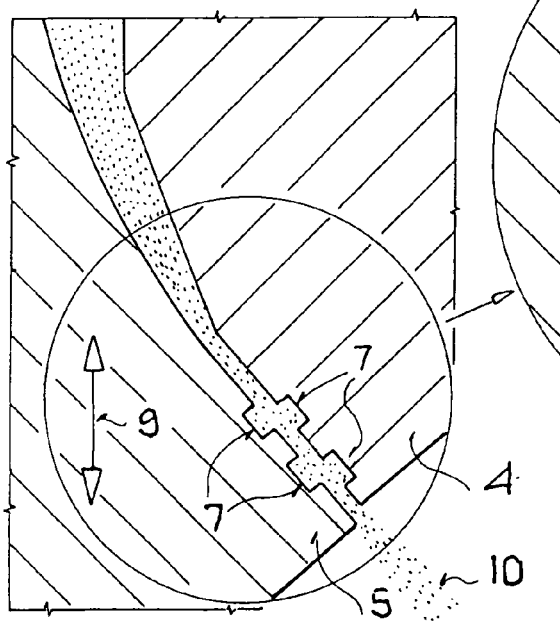
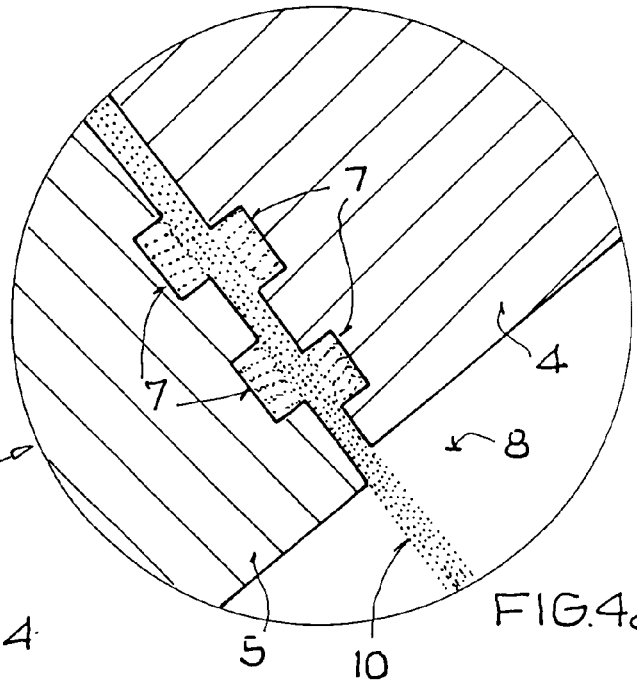
FIG.4a

FIG. 5
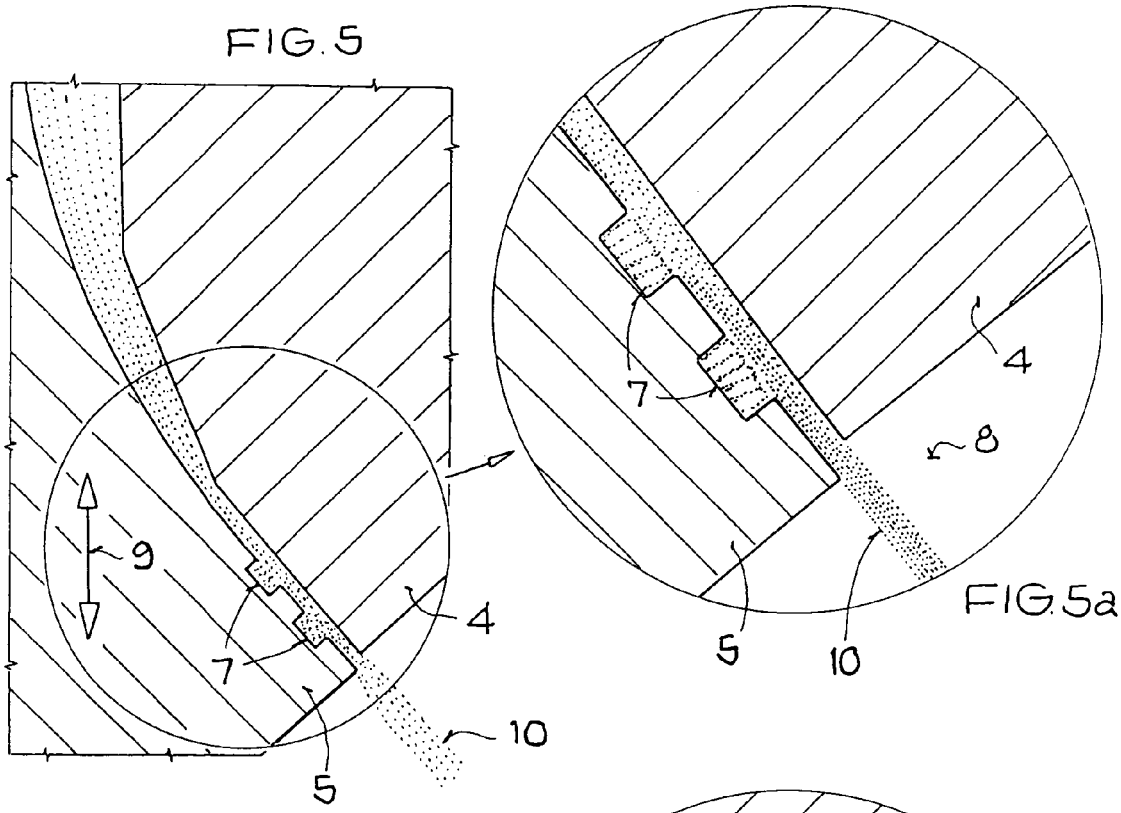
FIG. 5a
FIG. 6
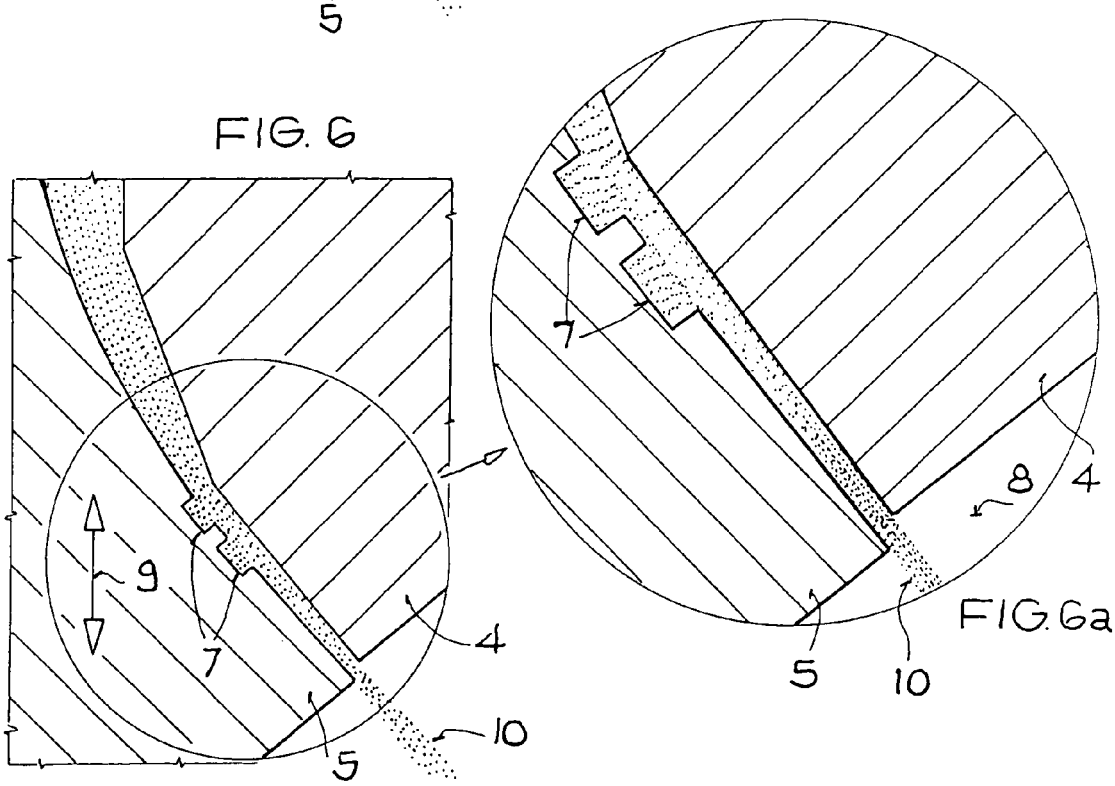
FIG. 6a

FIG. 7
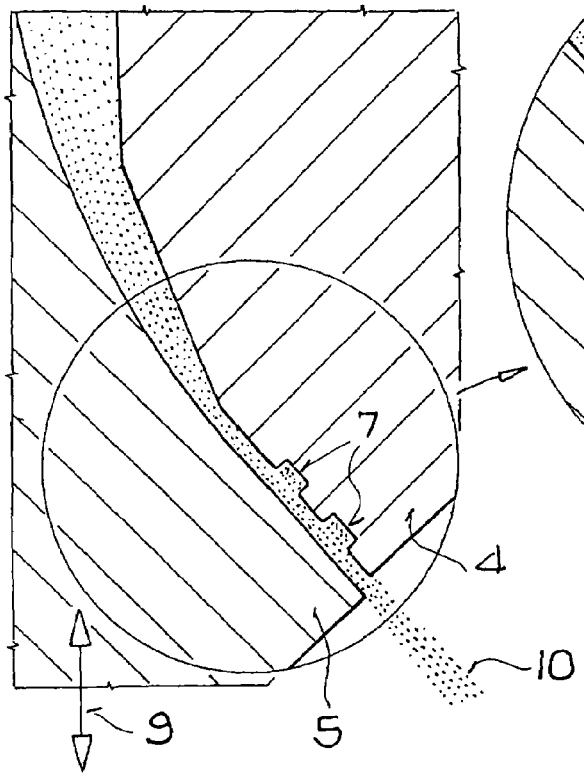
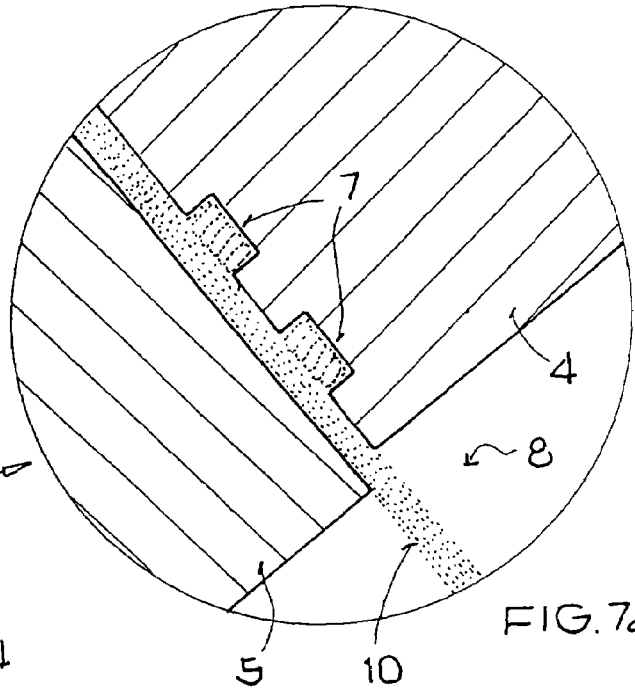
FIG. 7a

FUEL INJECTION NOZZLE FOR AN INTERNAL COMBUSTION ENGINE WITH DIRECT FUEL INJECTION

This is a Continuation-In-Part Application of International Application PCT/EP2003/006985 filed Jul. 1, 2003 and claiming the priority of German Application 102 31 583.3 filed Jul. 11, 2002.

BACKGROUND OF THE INVENTION

The invention resides in a fuel injection nozzle for an internal combustion engine with direct fuel injection including a nozzle housing with a nozzle seat, a nozzle needle with a conical closure body which, in its closed position, engages a seal surface formed on the nozzle seat but is movable axially outwardly by the nozzle needle for opening the nozzle to form a gap through which a hollow conical fuel jet is discharged from the nozzle into a combustion chamber of the engine.

In the operation of new spark ignition internal combustion engines with direct fuel injection the mixture formation in the combustion chambers has been improved by the use of modern fuel injection nozzles wherein, however, manufacturing tolerances affect the combustion and the formation of emissions.

DE 196 42 653 C1 discloses a method for forming a fuel mixture in an internal combustion engine with direct fuel injection wherein the fuel is injected during an opening stroke of a valve member relative to a valve seat of an injector and wherein the injection time is variably adjustable and the injection angle and also the fuel volume flow can be dynamically influenced.

Furthermore, DE 100 12 97 A1 discloses a method of forming an ignitable fuel mixture wherein the fuel is introduced into the combustion chamber of an internal combustion engine in at least two partial amounts by way of an injection nozzle with a closure body which is returned to its closing position after the injection procedure of each partial amount. The fuel jet is accelerated up to the exit from the nozzle since the nozzle opening has a curved or parabola-shaped discharge area which narrows down the nozzle opening uniformly up to the exit end.

Since different fuel injection nozzles generate, because of manufacturing tolerances, differently shaped fuel jets which affect the mixture formation and consequently the combustion process in different ways, before the installation of the injection nozzles into an internal combustion engine the respective geometries of the nozzles would have to be corrected that is adapted to one another, which is hardly possible.

It is the object of the present invention to provide for simple means on the fuel injection nozzle of an internal combustion engine with direct fuel injection whereby an improved combustion process can be achieved in spite of manufacturing tolerances.

SUMMARY OF THE INVENTION

In an injection nozzle for an internal combustion engine including a nozzle housing, a closure member disposed in a nozzle opening and connected to a nozzle needle for axially moving the closure member outwardly off its seat in the nozzle opening to open the nozzle by providing a gap to permit fuel to be discharged into a combustion chamber of an internal combustion engine so as to form a fuel injection cone, the nozzle seal and the closure member have seal surface areas provided with turbulence chambers for imparting turbulence to the fuel flowing through the gap in order to more finely atomize the fuel forming the fuel cone in the combustion chamber.

By providing the turbulence spaces or respectively, chambers in the surface of the closure body and/or the nozzle seat the turbulence of the fuel flow in the injection nozzle is increased shortly before the fuel enters the combustion chamber so that the break up of the fuel flow is increased, whereby smaller droplets are formed. As a result, the atomization properties of the injected fuel jet are improved, manufacturing-based tolerance variations are compensated for and the properties of the engine combustion, particularly fuel consumption and engine emissions, are improved.

Especially in internal combustion engines with direct fuel injection and spark ignition, an ignitable air/fuel mixture must be present in the area of the spark plug within a very short time. However, the fuel injectors are subject to certain manufacturing variations which results in different injection jet formations. With the increased turbulence shortly ahead of the nozzle discharge opening the jet variations resulting from the manufacturing tolerances are equalized particularly in the recirculation areas in the combustion chamber so that the jet formation is closer to the desirable ideal formation.

Furthermore, the increased turbulence provides for an increased break up of the lamellar fuel flow so that smaller fuel droplets are formed which are easier vaporized whereby the penetration distance of the droplets is reduced and, during late injections in the compression stroke, piston wetting is reduced.

In one embodiment of the invention, in, or respectively, immediately in front of, the sealing surface of the nozzle seat a turbulence chamber in the nozzle seat and in, or respectively, immediately in front of, the sealing surface of the closure body another turbulence chamber is provided so that two turbulence chamber is arranged so that two turbulence chambers are arranged during a particular operating position of the fuel injection nozzle relative to the jet axis opposite one another. By the arrangement of two chambers in, or respectively, in front of, the seal area, the turbulence of the nozzle flow in the gap area between the nozzle seat and the closure member is increased so that the fuel atomization is also increased. In this way, manufacturing tolerances can be compensated for, that is, the flow behavior of the fuel ejected from the fuel injection nozzle is little affected by the manufacturing tolerances.

In another embodiment of the invention at least one turbulence chamber is provided in, or respectively, immediately ahead of, the sealing surface of the nozzle seat and in, or respectively, directly ahead of, the sealing surface of the closure member in such a way that two turbulence chambers are arranged in a particular operating position displaced relative to the jet axis. Also, in this way, the atomizing of the fuel in the combustion chamber is increased whereby the combustion of the fuel in the engine is further improved.

In another embodiment of the invention, two turbulence chambers are provided in the gap area between the nozzle seat and the closure body in, or immediately ahead of, the seal area of the nozzle seat. With this measure, the droplets in the interior of the injected fuel cone are further atomized and their penetration to the piston surface is prevented. This measure is particularly advantageous for a stratified charge combustion process since the fuel is injected late during the compression stroke and the wetting of the piston with fuel must be prevented.

In another embodiment of the invention, two turbulence chambers are arranged at the nozzle seat and the closure member of the fuel injection nozzle in, or respectively, immediately ahead of, the seal area of the nozzle seat and at least two turbulence chambers are provided in, or respectively, immediately ahead of, the seal area of the closure member, one after the other in the stroke direction of the closure member such that two turbulence chambers are arranged opposite one another during operation of the fuel injection nozzle. In this way, the atomization of the fuel droplets is further increased. With the controlled turbulence generation in the whole area of the injected fuel jet, turbulence differences caused by manufacturing tolerances are subdued and the desired jet configuration is approximated. Alternatively, the turbulence chambers arranged at the closure member can be so formed that, in an operating position, two respective chambers are displaced relative to the jet axis.

In another embodiment of the invention, the turbulence chamber, provided in, or respectively immediately ahead of, the seal surface of the nozzle seat and/or in, or respectively immediately ahead of, the seal surface of the closure member have the form of a groove extending circumferentially around the seal surface areas. In this way, increased turbulence is achieved in the fuel flow all around the fuel cone whereby the breakup of the laminar fuel flow is reinforced and consequently smaller droplets are injected into the combustion chamber.

The measures referred to above are used preferably in connection with injection nozzles for internal combustion engines with spark ignition wherein the fuel is injected in the form of a hollow cone, and particularly in connection with a stratified charge combustion process. In such internal combustion engines, the fuel is so injected that, at the end of the hollow fuel cone, a torus-shaped swirl is formed and the spark plug is arranged in the combustion chamber of the engine so that the electrodes of the spark plug disposed outside the fuel cone extend from the outside into the torus-shaped cone. With the arrangement of the turbulence chambers in or, respectively, immediately ahead of, the seal areas of the nozzle seat, the turbulence is increased specifically in the outer area of the injected fuel cone whereby the formation of the torus-shaped edge swirl is more distinct. In jet-controlled or a stratified charge combustion, the necessary symmetry of the torus-shaped swirl is maintained by the fuel injection nozzle according to the invention and a tilting of the swirl is prevented. As a result, ignition failures are avoided.

Further features and feature combination will become more readily apparent from the following description of exemplary embodiments of the invention on the basis of the accompanying drawings:

BRIEF DESCRIPTION OF THE DRAWINGS

FIG. 3 shows, in an enlarged sectional view, a seal area in a gap between the nozzle seat and the closure member for the arrangement as shown in FIG. 2, FIG. 3*a* is an enlarged sectional view of the turbulence chambers shown in FIG. 3, FIG. 4 shows, in an enlarged sectional view, a gap area between the nozzle seat and the closure member with displaced turbulence chambers, FIG. 4*a* is an enlarged sectional view of the turbulence chambers shown in FIG. 4, FIG. 5 shows, in an enlarged cross-sectional view, a seal area in a gap between the nozzle seat and the closure member with two turbulence chambers in the seal area of the closure member, FIG. 5*a* is an enlarged sectional view of the turbulence chambers shown in FIG. 5, FIG. 6 shows, in an enlarged cross-sectional view a gap in the seal area between the nozzle seat and the closure member with two turbulence chambers arranged at the upstream end of the seal area of the closure member, FIG. 6*a* is an enlarged sectional view of the turbulence chambers as shown in FIG. 6, FIG. 7 shows, in an enlarged cross-sectional view, a gap in the seal area between the nozzle seat and the closure member with two turbulence chambers arranged in the seal area of the nozzle seat, and FIG. 7*a* is an enlarged cross-sectional view of the turbulence chambers shown in FIG. 7.

DESCRIPTION OF THE VARIOUS EMBODIMENTS

Figure 1:
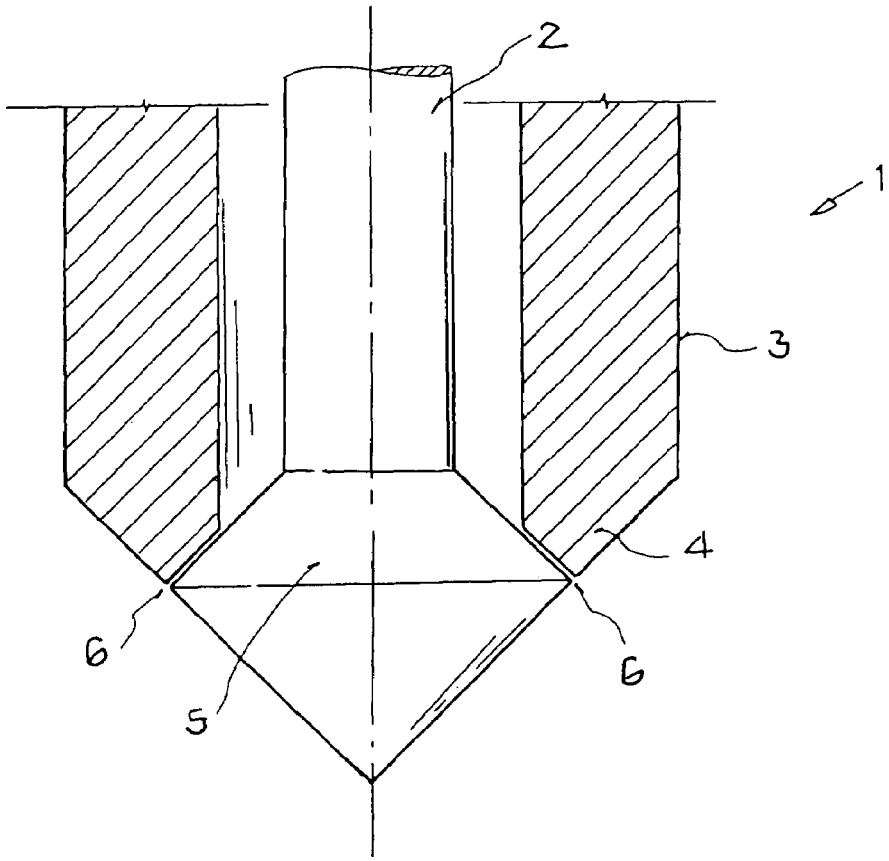
FIG. 1 is a cross-sectional view of a fuel injection nozzle with an outwardly opening closure member.

FIG. 1 shows a fuel injection nozzle 1 with a nozzle needle 2 and a closure member 5 disposed in a housing 3 of the fuel injection nozzle 1, In the area of the combustion chamber the nozzle 1 includes a nozzle seat 4, which is engaged by the closure member 5 when the nozzle is closed. The closure member 5 is connected at its upper end via the nozzle needle 2 to an operating mechanism which is not shown in the figures as it is conventional. Preferably, a piezo-actuator is used in the operating mechanism which expands when subjected to an electrical voltage providing for an operating stroke of the closure member 5 corresponding to the voltage applied. The fuel injection nozzle, that is, the closure member 5 is biased into a sealing position by a return spring which is not shown. The closure member 5 is moved to an operating position by way of the nozzle needle 2 such that a gap 6 is established between the closure member 5 and the nozzle seat 4.

Figure 2:
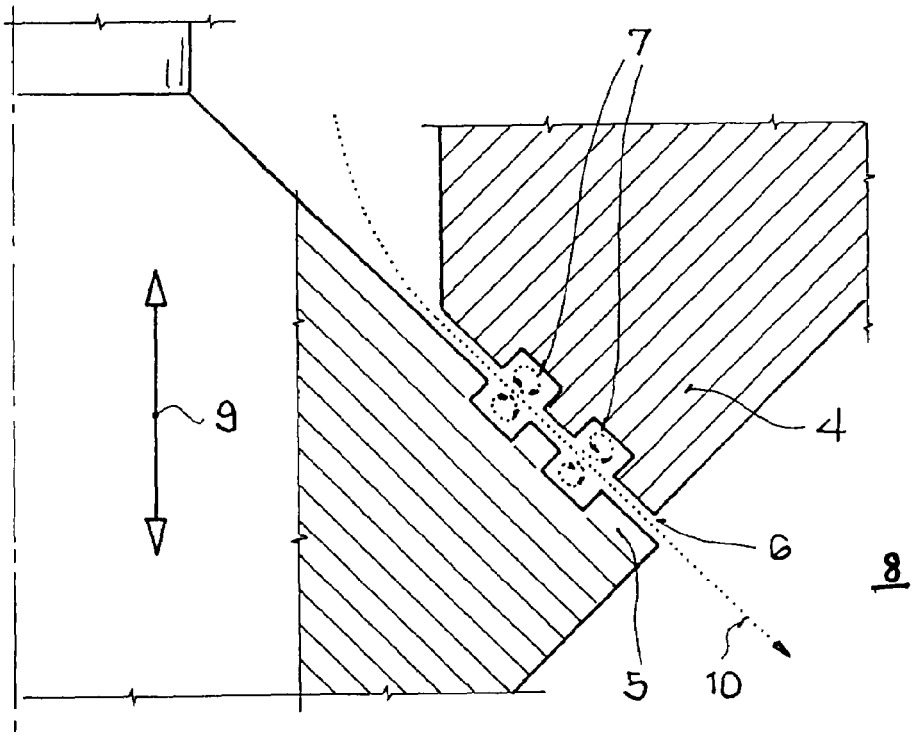
FIG. 2 shows, in an enlarged sectional view, a gap area between the nozzle seat and a closure member of the fuel injection nozzle with four turbulence chambers.

As shown in FIG. 2, the closure member 5 is moved to an operating position (open position) in the stroke direction 9 wherein the fuel can be injected through the gap 6 into a combustion chamber 8 of an internal combustion engine.

FIG. 2 shows turbulence chambers 7 arranged in the seal area of the closure member 5 and also in the seal area of the nozzle seat 4 such that the fuel is discharged into the combustion chamber 8 with increased turbulence in the fuel jet 10 thereby increasing the atomization of the fuel.

The fuel jet 10 being discharged through the gap 6 from the fuel injection nozzle is injected into the combustion chamber 8 as shown in FIG. 3 with increased turbulence so that small droplets are formed when entering the combustion chamber 8 for an optimal combustion of the injected fuel. The fuel injection nozzle according to the invention is preferably used in connection with spark ignition internal combustion engines with a so-called fuel jet guided combustion process. In accordance therewith the fuel is injected in a stratified charge operation preferably during the compression stroke in such a way that the fuel injected into the combustion chamber 8 forms therein a torus-shaped swirl. In such a combustion process, a spark plug initiating ignition is so arranged in the combustion chamber 8 that the electrodes of the spark plug extend into the torus-shaped swirl but, during the fuel injection, are disposed outside the circumferential area of the hollow fuel cone. In order to achieve an optimal combustion of the injected fuel the torus-shaped swirl must be symmetrical and uniform without any tilting. With the increased turbulence established in the hollow fuel injection cone a uniform fuel distribution is obtained and tilting of the torus-shaped swirl is prevented.

FIGS. 4, 4*a* show the closure member 5 of the fuel injection nozzle in an operating position with the turbulence chambers 7 provided between the nozzle seat 4 and the closure member 5 in a displaced arrangement so that the turbulence in the fuel jet 10 is increased in different areas.

FIGS. 5, 5*a* and 6, 6*a* show an embodiment of the invention wherein two turbulence chambers 7 are provided in the seal area of the closure member by way of which the turbulence of the injected fuel is increased. As shown in FIG. 6, the turbulence chambers 7 are arranged at the upstream end of the seal area of the closure member more remote from the combustion chamber than the turbulence chambers shown in FIGS. 5 and 5*a*.

As shown in FIGS. 7 and 7*a*, the turbulence chambers may be arranged also in the seal area of the nozzle seat so that in the fuel cone turbulence is increased at the outside of the fuel cone whereby the torus-shaped swirl needed for the fuel jet guided combustion process is reinforced. The aim in this case is to obtain a symmetrical swirl and a uniform fuel distribution in the outer area of the fuel cone so that in undesired tilting of the swirl is prevented. Furthermore, the formation of streaks at the end of the fuel injection cone should be avoided.

By way of the examples shown herein an optimal combustion is facilitated with the proposed fuel injection nozzle and a clearly defined torus-shaped swirl is obtained with the jet guided combustion process which is achieved by the increased atomization of the fuel particles in the rim area of the swirl. Another advantage is that manufacturing inaccuracies during the manufacture of fuel injection nozzles which detrimentally affect the mixture formation in internal combustion engines with direct fuel injection with spark ignition are compensated for.

Preferably, in all embodiments presented herein, the fuel injection nozzle is so designed that the fuel cone discharged from the injection nozzle has a cone angle of 70° to 100°. Furthermore, the turbulence chambers provided in accordance with the invention in the nozzle seat or the closure member 5 are flexible in their form that is, the turbulence chamber could have different geometric configurations and also the distance between the individual turbulence chambers could be flexible. Preferably, all the turbulence chambers have a distance from the combustion chamber of at least 60 μm so that there is a sufficiently large scaling area for sealing the fuel injection nozzle. Particularly, the turbulence chambers from a depth of 30 μm in the nozzle seat area as well as in the closure member. It is advantageous if, with the provision of several turbulence chambers, they are so arranged that they are spaced by a distance of about 60 μm. It is furthermore conceivable that the turbulence chambers are arranged in an area within the fuel injection nozzle adjacent the sealing area so that a certain increase in turbulence in the fuel is achieved before the fuel flows into the gap 6 between the nozzle seat and the closure member. Furthermore, several turbulence chambers with different geometric configurations may be provided on the side of the nozzle seat and also on the side of the closure member.

What is claimed is:

1. A fuel injection nozzle for injecting fuel into a combustion chamber of an internal combustion engine, comprising a nozzle housing (1) having a nozzle opening with a nozzle seat (4) at one end thereof, a closure member (5) movably supported in the nozzle housing (1) so as to be seated in the nozzle opening and forming a seal area, a nozzle needle (2) axially movably supported in the nozzle housing (1) and carrying at one end the closure member (5) for lifting the closure member outwardly off its seat (4) in the nozzle opening where, in its closed position, the closure member (5) is in sealing engagement with the nozzle seat (4), but from which it is raised outwardly during operation so as to form a gap between the nozzle seat (4) and the closure member (5) to permit fuel to flow through the gap and into the combustion chamber where it forms a hollow cone, at least one of the nozzle seat (4) and the closure member (5) having at least one turbulence chamber (7) arranged in said seal area for imparting turbulence to the fuel flowing through the gap for injection into the combustion chamber.

2. A fuel injection nozzle according to claim 1, wherein, in the seal area of the nozzle seat and in the seal area of the closure member (5), at least one turbulence chamber (7) is provided and the turbulence chambers in the nozzle seat and in the closure member (5) are arranged opposite one another.

3. A fuel injection nozzle according to claim 1, wherein, in the sealing area of the nozzle seat and in the seal area of the closure member (3), there is at least one turbulence chamber (7) arranged in such a way that in the operating position of the valve the turbulence chambers are displaced relative to one another.

4. A fuel injection nozzle according to claim 1, wherein between the nozzle seat and the closure member two turbulence chambers are arranged in the seal area of the nozzle seat.

5. A fuel injection nozzle according to claim 1, wherein between the nozzle seat and the closure member two turbulence chambers are arranged in the seal area of the closure member (5).

6. A fuel injection nozzle according to claim 1, wherein at least two turbulence chambers are provided in the nozzle seat area and at least two turbulence chambers are provided in the seal area of the closure member spaced in axial direction of the valve needle and the turbulence chambers are so arranged that, in an operating position of the closure member, they are disposed opposite the two turbulence chambers of the nozzle seat.

7. A fuel injection nozzle according to claim 1, wherein at least two turbulence chambers are provided in the nozzle seat area and at least two turbulence chambers are provided in the seat area of the closure member and the turbulence chambers are so arranged that, in an operating position of the closure member, the two turbulence chambers of the closure member are displaced axially with respect to the two turbulence chambers of the nozzle seat.

8. A fuel injection nozzle according to claim 1, wherein the turbulence chambers in the nozzle seat area and the turbulence chambers in the seal area of the closure member are circumferential grooves.

9. A fuel injection nozzle according to claim 1, wherein the gap formed between the nozzle seat surface and the closure member surface is disposed at such an angle that the fuel jet forms a cone with a cone angle of 70° to 100°.

* * * * *